US005794402A

United States Patent [19]

Dumlao et al.

[11] Patent Number: 5,794,402

[45] Date of Patent: Aug. 18, 1998

[54] MODULAR POLYMER MATRIX COMPOSITE SUPPORT STRUCTURE AND METHODS OF CONSTRUCTING SAME

[75] Inventors: Chris Dumlao, Pleasanton; Eric Abrahamson, Palo Alto, both of Calif.

[73] Assignee: Martin Marietta Materials, Inc., Raleigh, N.C.

[21] Appl. No.: 723,109

[22] Filed: Sep. 30, 1996

[51] Int. Cl.[6] ..... A47B 13/08

[52] U.S. Cl. ..... 52/783.17; 52/783.11; 52/263; 52/783.19; 14/73.1

[58] Field of Search ..... 14/73, 73.1; 52/262, 52/263, 783.11, 783.17, 783.19, 793.1, 796.1

[56] References Cited

U.S. PATENT DOCUMENTS

| | | | |
|---|---|---|---|
| 1,754,784 | 4/1930 | Borsodi . | |
| 2,211,513 | 8/1940 | Nagin . | |
| 2,307,869 | 1/1943 | Tench | 14/73 |
| 2,907,417 | 10/1959 | Doerr | 14/73 X |
| 3,078,385 | 2/1963 | Immethun . | |
| 3,104,194 | 9/1963 | Zahorski . | |
| 3,112,532 | 12/1963 | Slowinski . | |
| 3,257,764 | 6/1966 | Cripe . | |
| 3,302,361 | 2/1967 | Oudheusden, Jr. et al. . | |
| 3,607,592 | 9/1971 | Jenkins . | |
| 3,708,385 | 1/1973 | Immethun . | |
| 3,849,237 | 11/1974 | Zetlin . | |
| 3,906,571 | 9/1975 | Zetlin . | |
| 4,051,289 | 9/1977 | Adamson . | |
| 4,084,029 | 4/1978 | Johnson et al. . | |
| 4,177,306 | 12/1979 | Schulz et al. . | |
| 4,185,440 | 1/1980 | Finsterwalder . | |
| 4,186,535 | 2/1980 | Morton | 52/783.11 X |
| 4,223,053 | 9/1980 | Brogan . | |
| 4,229,919 | 10/1980 | Hughes | 52/263 |
| 4,292,364 | 9/1981 | Wesch et al. . | |

(List continued on next page.)

FOREIGN PATENT DOCUMENTS

| | | |
|---|---|---|
| 58651 | 4/1941 | Denmark . |
| 0 413 500 | 2/1991 | European Pat. Off. . |
| 1 023 784 | 2/1958 | Germany . |
| WO 81/01807 | 7/1981 | WIPO . |
| WO 94/25682 | 11/1994 | WIPO . |

OTHER PUBLICATIONS

"*Plastics & Composites In Construction*," Engineering News–Record, ENR Special Advertising Section (Nov. 1995), 20 pp.

Goldstein, "*Catching Up On Composites*," Civil Engineering (Mar. 1996) pp. 47–49.

Head, "*High Performance Structural Materials Advanced Composites*," draft of paper to be given at the Copenhagen IABSE Conference, Copenhagen, Denmark, Jun. 1996, 18 pp.

Head, P.R., "*Advanced Composites In Civil Engineering –A Critical Overview At This High Interest, Low Use Stage of Development*," pp. 3–15 (El–Badry, Mamdouh, Ed., Advanced Composite Materials in Bridges and Structures, 2nd Annual Conference, Aug. 11–14, 1996; The Canadian Society for Civil Engineering (1996)).

(List continued on next page.)

*Primary Examiner*—Beth Aubrey

[57] ABSTRACT

A modular structural section for use in support structures such as load bearing decks or highway bridges. The modular structural section includes at least one beam and a load bearing deck preferably formed of a polymer matrix composite material. The deck includes a core having elongated core members having a polygonal shape, preferably a trapezoidal shape. Alternatively, the load bearing deck contains at least one sandwich panel suitable for applications such as barge decks, hatchcovers, and other load bearing wall applications. Methods of constructing a support structure utilizing the novel modular structural section and support members are also provided.

31 Claims, 3 Drawing Sheets

U.S. PATENT DOCUMENTS

| | | | |
|---|---|---|---|
| 4,307,140 | 12/1981 | Davis . | |
| 4,356,678 | 11/1982 | Andrews et al. . | |
| 4,409,274 | 10/1983 | Chaplin et al. . | |
| 4,416,097 | 11/1983 | Weir | 52/262 X |
| 4,467,728 | 8/1984 | Horne . | |
| 4,525,965 | 7/1985 | Woelfel . | |
| 4,574,108 | 3/1986 | Fakirov et al. . | |
| 4,588,443 | 5/1986 | Bache . | |
| 4,600,634 | 7/1986 | Langer . | |
| 4,617,217 | 10/1986 | Michaud-Soret . | |
| 4,629,358 | 12/1986 | Springston et al. . | |
| 4,706,319 | 11/1987 | Sivachenko et al. . | |
| 4,709,456 | 12/1987 | Iyer . | |
| 4,788,269 | 11/1988 | Vu et al. . | |
| 4,908,254 | 3/1990 | Fischer et al. . | |
| 4,945,594 | 8/1990 | Tomb . | |
| 4,976,490 | 12/1990 | Gentle . | |
| 4,982,538 | 1/1991 | Horstketter . | |
| 4,991,248 | 2/1991 | Allen . | |
| 5,033,147 | 7/1991 | Svensson | 14/73 |
| 5,052,164 | 10/1991 | Sandow . | |
| 5,052,167 | 10/1991 | Scharch . | |
| 5,070,668 | 12/1991 | Lieberman . | |
| 5,179,152 | 1/1993 | Shimaoka et al. . | |
| 5,205,098 | 4/1993 | Landis et al. . | |
| 5,225,237 | 7/1993 | Magnani . | |
| 5,256,223 | 10/1993 | Alberts et al. . | |
| 5,305,568 | 4/1994 | Beckerman . | |
| 5,309,690 | 5/1994 | Symons . | |
| 5,417,792 | 5/1995 | Scola et al. . | |
| 5,498,763 | 3/1996 | McGarry et al. . | |
| 5,508,082 | 4/1996 | Ehrat et al. . | |
| 5,508,085 | 4/1996 | Lockshaw et al. . | |
| 5,514,444 | 5/1996 | Buyny et al. . | |
| 5,529,808 | 6/1996 | Eguchi et al. . | |
| 5,547,735 | 8/1996 | Roebroeks et al. . | |
| 5,585,155 | 12/1996 | Heikkila et al. . | |
| 5,591,933 | 1/1997 | Li et al. . | |
| 5,601,888 | 2/1997 | Fowler . | |
| 5,601,919 | 2/1997 | Symons . | |
| 5,612,117 | 3/1997 | Bélanger et al. . | |

OTHER PUBLICATIONS

Seible, F., "*Advanced Composites Materials For Bridges In The 21st Century*," pp. 17–30 (El–Badry, Mamdouh, Ed., Advanced Composite Materials in Bridges and Structures, 2nd Annual Conference, Aug. 11–14, 1996; The Canadian society for Civil Engineering (1996)).

Cosenza, E., et al., "*Experimental Evaluation Of Bending And Torsional Deformability Of FRP Pultruded Beams*," pp. 117–124 (El–Badry, Mamdouh, Ed., Advanced Composite Materials in Bridges and Structures, 2nd Annual Conference, Aug. 11–14, 1996; The Canadian Society for Civil Engineering (1996)).

Sheard, P., et al. "*Eurocrete –Using Advanced Composites To Reinforce Durable Concrete Structures*," pp. 159–164 (El–Badry, Mamdouh, Ed., Advanced Composite Materials in Bridges and Structures, 2nd Annual Conference, Aug. 11–14, 1996; The Canadian Society for Civil Engineering (1996)).

Aref, A., et al. "*Design And Analysis Procedures For A Novel Fiber Reinforced Plastic Bridge Deck*," pp. 743–750 (El–Badry, Mamdouh, Ed., Advanced Composite Materials in Bridges and Structures, 2nd Annual Conference, Aug. 11–14, 1996; The Canadian Society for Civil Engineering (1996)).

Karbhari, V.M., "*Fiber Reinforced Composite Decks For Infrastructure Renewal*," pp. 759–766 (El–Badry, Mamdouh, Ed., Advanced Composite Materials in Bridges and Structures, 2nd Annual Conference, Aug. 11–14, 1996; The Canadian Society for Civil Engineering (1996)).

Johansen, G. Eric, et al., "*Design And Construction Of Two FRP Pedestrian Bridges In Haleakala National Park, Maui, Hawaii*, " pp. 975–982 (El–Badry, Mamdouh, Ed., Advanced Composite Materials in Bridges and Structures, 2nd Annual Conference, Aug. 11–14, 1996; The Canadian Society for Civil Engineering (1996)).

Johansen et al., "*Design Of An Advanced Composite Material Space Frame System*, " pp. 1–9 of Session 7–B (Composites Institute's 51st Annual Conference & Expo '96, Feb. 5–7, 1996; SPI Composites Institute (1996)).

Gentry, "*Application and Performance Of Sandwich Panel Composites For Transportation Facilities*, " pp. 1–6 of Session 7–C (Composites Institute's 51st Annual Conference & Expo '96, Feb. 5–7, 1996; SPI Composites Institute (1996)).

Johansen et al., "*Advanced Composite Material Support Frames: An Evaluation Of The Bow Meadow Bridge At Lake Crescent, WA*," pp. 1–9 of Session 7–D (Composites Institute's 51st Annual Conference & Expo '96, Feb. 5–7, 1996; SPI Composites Institute (1996)).

Barbero et al., "*Stiffening Of Steel Stringer Bridges With Carbon Fiber Reinforced Plastics For Improved Bridge Rating*," pp. 1–3 of Session 7–E (Composites Institute's 51st Annual Conference & Expo '96, Feb. 5–7, 1996; Composites Institute (1996)).

Meteer, "*Designing Structural Sandwich Composites*," pp. 1–6 of Session 8–D (Composites Institute's 51st Annual Conference & Expo '96, Feb. 5–7, 1996; SPI Composites Institute (1996)).

Churchman, Allan E., "*Design Considerations For Advanced Composite Materials*," 7 p. (Fiberglass–Composite Bridges Seminar, 13th Annual Bridge Conference and Exhibition (Jun. 3, 1996)).

Witcher, Daniel A., "*Processing And Fabricating FRP Composites For Bridge Structures*," 9 pp. (Fiberglass–Composite Bridges Seminar, 13th Annual Bridge Conference and Exhibition (Jun. 3, 1996)).

Busel, John, Ed., "*FRP Composites In Construction Applications*," A Profile in Progress, SPI Composites Instituted (Nov., 1995) pp. 11–13, 15–16, 19–20, 49, 51–52, 58, 621, 73–74, 76–78 and 81.

"*Tom's Creek Bridge Rehabilitation & Field Composite Durability Study*," Virginia Tech, Virginia Transportation Research Council; Morrison Molded Fiber Glass (1996) 2 pp.

Standard Specifications for Highway Bridges, 15th Edition (1992), American Association of State Highway and Transportation Official, Inc., Washington, D.C. 13 pp.

Introduction to Composites, Third Edition, The Composites Institute Of The Society Of The Plastics Industry, Inc. (released Jan., 1995) pp. 67–84.

MODULAR POLYMER MATRIX COMPOSITE SUPPORT STRUCTURE AND METHODS OF CONSTRUCTING SAME

FIELD OF THE INVENTION

This invention relates to support structures such as bridges, piers, docks, load bearing decking applications, such as hulls and decks of barges, and load bearing walls. More particularly, this invention relates to a modular composite load bearing support structure including a polymer matrix composite modular structural section for use in constructing bridges and other load bearing structures and components.

BACKGROUND OF THE INVENTION

Space spanning structures such as bridges, docks, piers, load bearing walls, hulls, and decks which have provided a span across bodies of water or separations of land and water and/or open voids have long been made of materials such as concrete, steel or wood. Concrete has been used in building bridges and other structures including the columns, decks, and beams which support these structures.

Such concrete structures are typically constructed with the concrete poured in situ as well as using some preformed components precast into structural components such as supports and transported to the site of the construction. Constructing such concrete structures in situ requires hauling building materials and heavy equipment and pouring and casting the components on site. This process of construction involves a long construction time and is generally costly, time consuming, subject to delay due to weather and environmental conditions, and disruptive to existing traffic patterns when constructing a bridge on an existing roadway.

On the other hand, pre-cast concrete structural components are extremely heavy and bulky. Therefore, they are also typically costly and difficult to transport to the site of construction due in part to their bulkiness and heavy weight. Although construction time is shortened as compared to poured in situ, extensive time, with resulting delays, is still a factor. Bridge construction with such precast forms is particularly difficult, if not impossible, in remote or difficult terrain such as mountains or jungle areas in which numerous bridges are constructed.

In addition to construction and shipping difficulties with concrete bridge structures, the low tensile strength of concrete can result in failures in concrete bridge structures, particularly in the surface of bridge components. Reinforcement is often required in such concrete structures when subjected to large loads such as in highway bridges. Steel and other materials have been used to reinforce concrete structures. If not properly installed, such reinforcements cause cracking and failure in the reinforced concrete, thereby weakening the entire structure. Further, the inherent hollow spaces which exist in concrete are highly subject to environmental degradation. Also, poor workmanship often contributes to the rate of deterioration.

In addition to concrete, steel also has been widely used by itself as a building material for structural components in structures such as bridges, barge decks, vessel hulls, and load bearing walls. While having certain desirable strength properties, steel is quite heavy and costly to ship and can share construction difficulties with concrete as described.

Steel and concrete are also susceptible to corrosive elements, such as water, salt water and agents present in the environment such as acid rain, road salts, chemicals, oxygen and the like. Environmental exposure of concrete structures leads to pitting and spalling in concrete and thereby results in severe cracking and a significant decrease in strength in the concrete structure. Steel is likewise susceptible to corrosion, such as rust, by chemical attack. The rusting of steel weakens the steel, transferring tensile load to the concrete, thereby cracking the structure. The rusting of steel in stand alone applications requires ongoing maintenance, and after a period of time corrosion can result in failure of the structure. The planned life of steel structures is likewise reduced by rust.

The susceptibility to environmental attack of steel requires costly and frequent maintenance and preventative measures such as painting and surface treatments. In completed structures, such painting and surface treatment is often dangerous and time consuming, as workers are forced to treat the steel components in situ while exposed to dangerous conditions such as road traffic, wind, rain, lightning, sun and the like. The susceptibility of steel to environmental attack also requires the use of costly alloys in certain applications.

Wood has been another long-time building material for bridges and other structures. Wood, like concrete and steel, is also susceptible to environmental attack, especially rot from weather and termites. In such environments, wood encounters a drastic reduction in strength which compromises the integrity of the structure. Moreover, wood undergoes accelerated deterioration in structures in marine environments.

Along with environmental attack, deterioration and damage to bridges and other traffic and load bearing structures occurs as a result of heavy use. Traffic bearing structures encounter repeated heavy loads of moving vehicles, stresses from wind, earthquakes and the like which cause deterioration of the materials and structure.

For the reasons described above, the United States Department of Transportation "Bridge Inventory" reflects several hundred thousand structures, approximately forty percent of bridges in the United States, made from concrete, steel and wood, are poorly maintained and in need of rehabilitation in the United States. The same is believed to be true for other nations.

The associated repairs for such structures are extremely costly and difficult to undertake. Steel, concrete and wood structures need welding, reinforcement and replacement. Decks and hulls of structures in marine environments rust, requiring constant maintenance and vigilance. In numerous instances, such repairs are not feasible or economically justifiable and cannot be undertaken, and thereby require the replacement of the structure. Further, in developing areas where infrastructures are in need of development or improvement, constructing bridges and other such structures utilizing concrete, steel and wood face unique difficulties. Difficulty and high cost has been associated with transporting materials to remote locations to construct bridges with concrete and steel. This process is more costly in marine environments where repairs require costly dry-docking or transport of materials. Also, the degree of labor and skill is very high using traditional building materials and methods.

Further, traditional construction methods have generally taken long time periods and required large equipment and massive labor costs. Thus, development and repair of infrastructures through the world has been hampered or even precluded due to the cost and difficulty of construction. Also, in areas where structures have been damaged due to deterioration or destroyed by natural disaster such as earthquake, hurricane, or tornado, repair can be disruptive to traffic or use of the bridge or structure or even delayed or prevented due to construction costs.

In addressing the limitations of existing concrete, wood and steel structures, some fiber reinforced polymer composite materials have been explored for use in constructing parts of bridges including foot traffic bridges, piers, and decks and hulls of some small vessels. Fiber reinforced polymers have been investigated for incorporation into foot bridges and some other structural uses such as houses, catwalks, and skyscraper towers. These composite materials have been utilized in conjunction with, and as an alternative to, steel, wood or concrete due to their high strength, light weight and highly corrosion resistant properties. However, it is believed that construction of traffic bridges, marine decking systems, and other load bearing applications built with polymer matrix composite materials have not been widely implemented due to extremely high costs of materials and uncertain performance, including doubts about long term durability and maintenance.

As cost is significant in the bridge construction industry, such materials have not been considered feasible alternatives for many load bearing traffic bridge designs. For example, high performance composites made with relatively expensive carbon fibers have frequently been eliminated by cost considerations. These same cost considerations have inhibited the use of composite materials in decking and hull applications.

In investigating providing structural components made from fiber reinforced polymer composite materials, components structures from prior materials such as steel, concrete and wood have been investigated. Steel trusses and supports have utilized triangular shapes welded together. Providing triangular structural components with composite materials has presented problems of failure in the resin bonded nodes of the triangular shape. Therefore, a modular structural composite component for structural supports is needed which overcomes this problem.

In view of the problems associated with bridges and other structures formed of steel, concrete, and wood described herein, there remains a need for a bridge or like support structure with the following characteristics: light-weight; low cost, pre-manufactured; constructed of structural modular components; easily shipped, constructed, and repaired without requiring extensive heavy machinery; and resistant to corrosion and environmental attack, even without surface treatment. There is also a need for a support structure which can provide the structural strength and stiffness for constructing a highway bridge or similar support structure. There is a further need for a load bearing deck to be utilized in a support structure or modular structural section as described.

SUMMARY OF THE INVENTION

In view of the foregoing, it is therefore an object of the present invention to provide a load bearing deck included in a modular structural section for a support structure suitable for a highway bridge structure or decking system in marine and other construction applications, constructed of modular sections formed of a lightweight, high performance, environmentally resistant material.

It is another object of the invention to provide a support structure having a deck, such as a highway bridge structure, which satisfies accepted design, performance, safety and durability criteria for traffic bearing bridges of various types.

It is another object of the present invention to provide such a deck as a part of a modular structural section of a support structure in the form of a traffic-bearing bridge in a variety of designs and sizes constructed of modular sections which can be constructed quickly, cost-effectively and with limited heavy machinery and labor.

It is also an object of the present invention to provide such a load bearing deck for a modular structural section for a support structure, such as a bridge, the bridge being constructed of components which can easily and cost-effectively be shipped to the site of construction as a complete kit.

It is likewise an object of the present invention to provide a support structure including a modular section which can be utilized to quickly repair or replace a damaged bridge, bridge section or like support structure.

It is another object of the present invention to provide a load bearing support structure including a modular structural section having a deck which can be used in decking, hull, and wall applications.

It is still another object of the invention to provide a support structure or bridge which requires minimal maintenance and upkeep with respect to surface treatment or painting.

These and other objects, advantages and features are satisfied by the present invention, which is directed to a polymer matrix composite modular load bearing deck as a part of a modular structural section for a support structure described herein for exemplary purposes in the form of a highway bridge and deck therefore. The support structure of the present invention includes a plurality of support members and at least one modular section positioned on and supported by the support members. The modular section is preferably formed of a polymer matrix composite. The modular section includes at least one beam and a load bearing deck positioned above and supported by the beam.

The load bearing deck of the modular section also includes at least one sandwich panel including an upper surface, a lower surface and a core. The core includes a plurality of substantially hollow, elongated core members positioned between the upper surface and the lower surface. Each of the elongated core members includes a pair of side walls. One of the side walls is disposed at an oblique angle to one of the upper and lower surfaces such that the side walls and the upper and lower surfaces, when viewed in cross-section, define a polygonal shape. Each core member has side walls positioned generally adjacent to a side wall of an adjacent core member. The polygonal shape of the core member preferably defines a trapezoidal cross-section formed of a polymer matrix composite material. The upper and lower surfaces are preferably an upper facesheet and lower facesheet formed of a polymer matrix composite material.

The polymer matrix composite support structure of the present invention can provide a support surface sufficient to support vehicular traffic and to conform to established design and performance criteria. Alternatively, the modular structural section, including the load-bearing deck and beam, can be used in constructing other support structures including space-spanning support structures. Further, the load bearing deck can also be used as a stand alone decking, hull, or wall system which can be integrated into a marine or construction system. The load bearing decking system can be utilized in numerous applications where load bearing decking, hulls and walls are required.

The support structure including the modular structural section according to the present invention also reduces tooling and fabrication costs. The support structure is easy to construct utilizing prefabricated components which are individually lightweight, yet structurally sound when utilized in combination. The modularity of the components enhances portability, facilitates pre-assembly and final positioning with light load equipment, and reduces the cost of shipping and handling the structural components. The support structure allows for easy construction of structures such as, but not limited to, bridges, marine decking applications and other construction and transportation applications.

In one embodiment of the bridge described herein for a 30 foot span highway bridge, the individual components including the beams and the sandwich panels for the deck of the modular section each weigh less than 3600 pounds. The bridge, being constructed of a number of modular sections including components manufactured from polymer matrix composites instead of concrete, steel and wood, provides individual modular components which are fault tolerant in manufacture, as twisting and small warpage can be corrected at assembly. These properties of the bridge components decrease the cost of manufacture and assembly for the bridge. These components, including lightweight modular structural sections manufactured under controlled conditions, also allow for low cost assembly of a number of applications, such as marine structures, including the various applications described herein.

Another aspect of the present invention is a method of constructing a support structure such as a highway bridge. The method comprises the following steps. First, a plurality of spaced-apart support members are provided. Next, a modular section of the type described above is positioned on the plurality of spaced-apart support members. Preferably, the modular section is positioned by: first, positioning at least one beam of the modular structural section upon adjacent of the support members preferably abutments; then positioning the load bearing deck upon the beam, then connecting the beam with the deck. The methods of the present invention provide significantly reduced time, labor and cost as compared to conventional methods of bridge and support structure construction utilizing concrete, wood and metal structures.

DETAILED DESCRIPTION OF THE PREFERRED EMBODIMENTS

The present invention now will be described more fully hereinafter with reference to the accompanying drawings, in which preferred embodiments of the invention are shown. This invention can, however, be embodied in many different forms and should not be construed as limited to the embodiments set forth herein; rather, Applicant provides these embodiments so that this disclosure will be thorough and complete, and will fully convey the scope of the invention to those skilled in the art.

Figure 1:
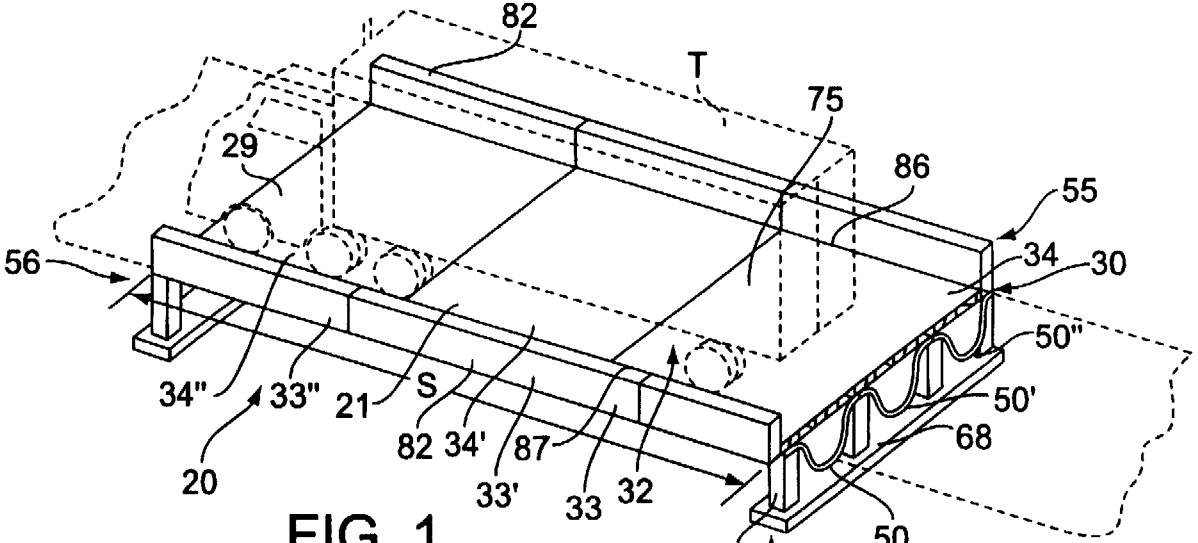
FIG. 1 is a perspective view of a load bearing support structure in the form of a load bearing traffic highway bridge according to the present invention and a truck traveling thereon.
Figure 2:
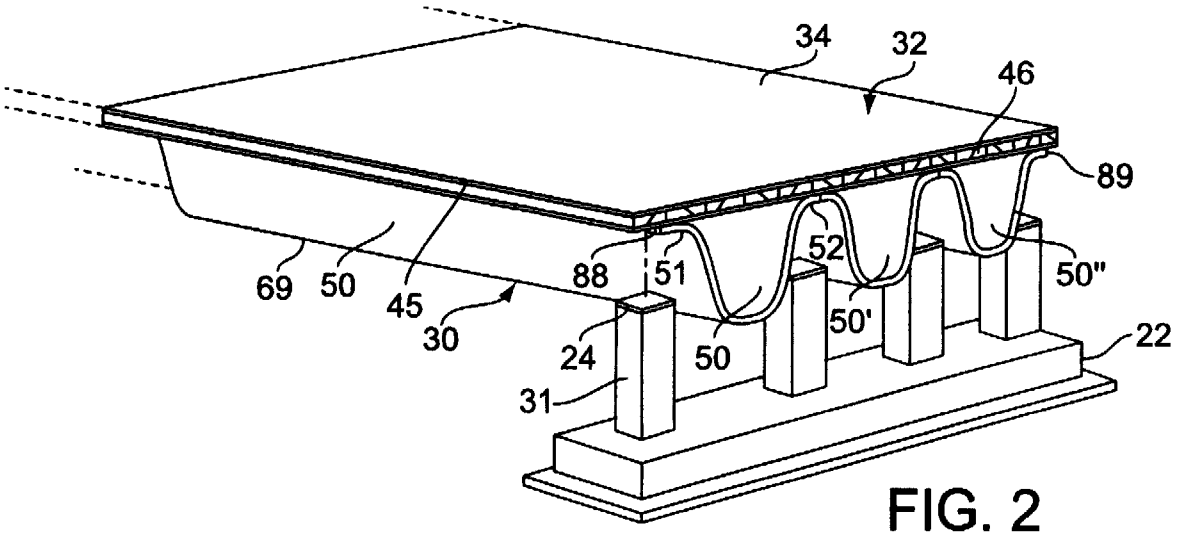
FIG. 2 is an exploded partial perspective view of a modular structural section of the bridge according to the present invention.

Referring now to the figures, a modular composite support structure in the form of a bridge structure 20 including a modular structural section 30 according to the present invention is shown (FIGS. 1–2). This embodiment of the bridge 20 is designed to exceed standards for bridge construction such as American Association of State Highway and Transportation Officials (AASHTO) standards. The AASHTO standards include design and performance criteria for highway bridge structures. The AASHTO standards are published in "*Standard Specifications for Highway Bridges*," American Association of State Highway and Transportation Officials, Inc., (15th Ed., 1992) which is hereby incorporated by reference in its entirety. Support structures, including bridges, of the present invention can be constructed which meet other structural, design and performance criteria for other types of bridges, construction and transportation support structures, and other applications including, but not limited to, road bearing decking systems and marine applications.

The support structure is described with reference to the traffic-bearing highway bridge 20 illustrated in FIGS. 1 and 2. The bridge 20 is a simply-supported highway bridge capable of withstanding loads from highway traffic such as the truck T. The bridge 20 has a span S defined by the length of the bridge 20 in the direction of travel of truck T. The bridge 20 comprises a modular structural section 30 and includes three beams 50, 50', 50" and a deck 32 supported on and connected with the beams 50, 50', 50" (FIG. 2). The modular structural section 30 is supported on support members 22.

In addition to a simply-supported bridge, alternatively, the bridge including the modular structural section can be provided in other types of bridges including lift span bridges, cantilever bridges, cable suspension bridges, suspension bridges and bridges across open spaces in industrial settings. A variety of spans can be provided including, but not limited to, short, medium and long span bridges. The bridge technology can also be supplied for bridges other than highway bridges such as foot bridges and bridge spans across open spaces in industrial settings.

Other space spanning support structures can also be constructed in a similar manner to that indicated including, but not limited to, bridge component maintenance (replacement decking, column/beam supports, abutments, abutment forms and wraps), marine structures (walkways, decking (small/large scale)), load bearing decking systems, drill platforms, hatch covers, parking decks, piers and fender systems, docks, catwalks, super-structure in processing and plants with corrosive environments and the like which provide an elevated support surface over a span, rail cross ties, space frame structures (conveyors and structural supports) and emission stack liners. Other structures such as railroad cars, shipping containers, over-the-road trailers, rail cars, barges and vessel hulls could also be constructed in a similar manner to that indicated.

The components of the bridge 20, including the modular structural section 30 and constituent deck 32 and beam 50, as described herein, can also be provided, individually and in combination, in such other support structures as described.

Figure 4:
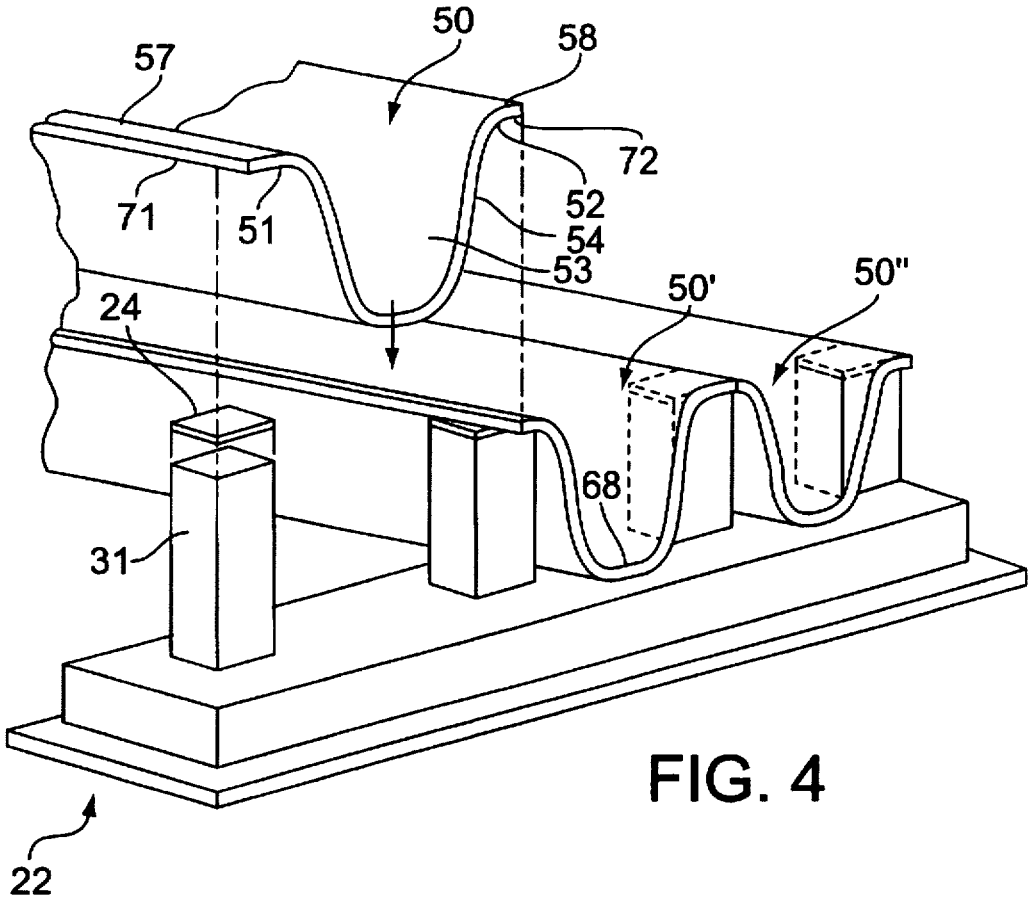
FIG. 4 is an exploded perspective view of a plurality of beams positioned on support members of the bridge of FIG. 2.

The support members 22 are shown as pre-cast concrete footings with vertical columns 31. As illustrated in FIG. 4, the columns 31 preferably have a bearing pad 24 connected on an upper end. The columns 31 are arranged and spaced apart a predetermined distance to facilitate supporting the beams 50, 50', 50". The beams 50 each have flanges 51, 52 which are positioned on the load pads 24 of the support members 22. In the bridge 20 of FIG. 1, the support members are positioned at opposite ends 55, 56 of the beams 50.

The support members or other support means can be provided in various shapes, configurations and materials including support members formed of composite materials, steel, wood or other materials. Further alternatively, the supports 22 can be provided in various shapes and configurations including, but not limited to, a flat abutment, a ledge type abutment or other supports. Alternatively, the beams 50 can be supported by support members 22 at various intermediate positions along the length of the beams 50. In other alternative embodiments, the support members or other support means can include the supports of an existing bridge replaced by the bridge 20 of the present invention. Additional support means depend on the type of support structure constructed.

The support members 22 are formed of concrete precast footings (FIGS. 1 and 2). Alternatively, the support members 22 can be formed of polymer matrix composite materials, as described herein, or other materials such as concrete poured in situ, steel, wood or other building materials.

In the embodiment of FIGS. 1–7, the modular structural section 30, including the deck 32 and preferably the beams 50, 50', 50" is formed of a polymer matrix composite comprising reinforcing fibers and a polymer resin. Suitable reinforcing fibers include glass fibers, including but not limited to E-glass and S-glass, as well as carbon, metal, high modulus organic fibers (e.g., aromatic polyamides, polybenzamidazoles, and aromatic polyimides), and other organic fibers (e.g., polyethylene and nylon). Blends and hybrids of the various fibers can be used. Other suitable composite materials could be utilized including whiskers and fibers such as boron, aluminum silicate and basalt.

The resin material in the modular structural section 30, including the deck 32 is preferably a thermosetting resin, and more preferably a vinyl ester resin. The term "thermosetting" as used herein refers to resins which irreversibly solidify or "set" when completely cured. Useful thermosetting resins include unsaturated polyester resins, phenolic resins, vinyl ester resins, polyurethanes, and the like, and mixtures and blends thereof. The thermosetting resins useful in the present invention may be used alone or mixed with other thermosetting or thermoplastic resins. Exemplary other thermosetting resins include epoxies. Exemplary thermoplastic resins include polyvinylacetate, styrene-butadiene copolymers, polymethylmethacrylate, polystyrene, cellulose acetatebutyrate, saturated polyesters, urethane-extended saturated polyesters, methacrylate copolymers and the like.

Polymer matrix composites can, through the selective mixing and orientation of fibers, resins and material forms, be tailored to provide mechanical properties as needed. These polymer matrix composite materials possess high specific strength, high specific stiffness and excellent corrosion resistance. In the embodiment shown in FIGS. 1–7, a polymer matrix composite material of the type commonly referred to as a fiberglass reinforced polymer (FRP) or sometimes, as glass fiber reinforced polymer (GFRP) is utilized in the deck 32 and preferably the beams 50, 50', 50". The reinforcing fibers of the modular structural section 30, including the deck 32 and the beams 50, 50', 50", are glass fibers, particularly E-glass fibers, and the resin is a vinylester resin. Glass fibers are readily available and low in cost. E-glass fibers have a tensile strength of approximately 3450 MPa (practical). Higher tensile strengths can alternatively be accomplished with S-glass fibers having a tensile strength of approximately 4600 MPa (practical). Polymer matrix composite materials, such as a fiber reinforced polymer formed of E-glass and a vinylester resin have exceptionally high strength, good electrical resistivity, weather and corrosion-resistance, low thermal conductivity, and low flammability.

The Deck

Figure 3:
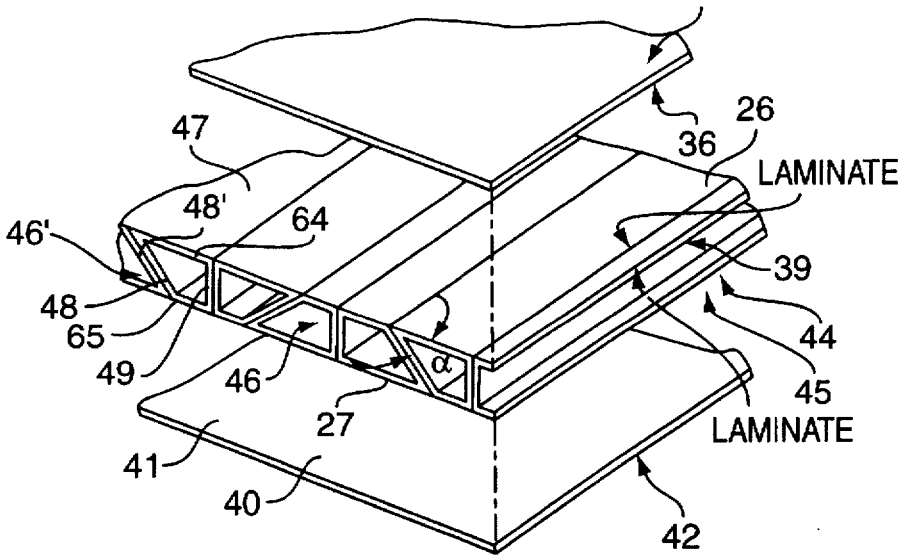
FIG. 3 is an exploded perspective view of a sandwich panel deck of FIG. 2 having trapezoidal core members.

In the bridge 20 including the modular section 30 shown in FIGS. 1–2, the deck 32 includes three sandwich panels 34, 34' 34". Alternatively, any number of panels can be utilized in a deck depending on the length of the desired span. As shown in FIG. 3, each sandwich panel 34 comprises an upper surface shown as an upper facesheet 35, a lower surface shown as a lower facesheet 40 and a core 45 including a plurality of elongate core members 46.

The core members 46 are shown as hollow tubes of trapezoidal cross-section (FIGS. 2–3 and 5–7). Each of the trapezoidal tubes 46 includes a pair of side walls 48, 49. One of the side walls 48 is disposed at an oblique angle $\alpha$ to one of the upper and lower facesheets 35, 40 such that the side walls 48, 49 and the upper wall 64 and lower wall 65, when viewed in cross-section, define a polygonal shape such as a trapezoidal cross-section (FIG. 3). The oblique angle $\alpha$ of the side wall 48 with respect to the upper wall 64 is preferably about 45°, but angles between about 30° and 45° can be provided in alternative embodiments. Each tube 46 has a side wall 48 positioned generally adjacent to a side wall 48' of an adjacent tube 46' (FIG. 3). Alternatively, the tubes 46 could be aligned in other configurations such as having a space between adjacent side walls.

The side walls 48, 48' disposed at an oblique angle $\alpha$ provide transverse shear stiffness for the deck core 45. This increases the transverse bending stiffness of the overall deck 32. The sidewall 48 shown at the preferred 45° angle $\alpha$ provides the highest bending stiffness. The trapezoidal tubes 46 also preferably have a vertical side wall 49 positioned between adjacent diagonal side walls 48, 48'. The vertical sidewall 49 provides structural support for localized loads subjected on the deck 32 to prevent excessive deflection of the top facesheet 35 along the span between the intersection of the diagonal walls 48, 48' and the upper facesheet 35.

Thus, the shape including the angled side wall 48 of the trapezoidal tube 46 provides stiffness across the cross-section of the tube 46. An adjacent tube 46' includes a side wall 48' angled in an opposite orientation between the upper and lower surface from the adjacent angled side wall 48. Providing side walls 48, 49 at varying orientations preserves the mathematical symmetry of the cross-section of the tubes 46. When normalized by weight between the side wall 48 and one of the upper wall 64 and lower wall 65, the trapezoidal tube 46 with at least a 45° angle has a transverse shear stiffness 2.6 times that of a tube with a square cross-section. Alternatively, for a tube with an oblique angle of about 30°, the transverse shear stiffness is 2.2 times that of a tube with a square shaped cross-section.

The span between the diagonal side walls 48, 48' and the vertical sidewall 49 can be provided in a variety of predetermined distances. A variety of sizes, shapes and configurations of the elongate core members can be provided.

Various other polygonal cross-sectional shapes can also be employed, such as quadrilaterals, parallelograms, other trapezoids, pentagons, and the like.

As explained, adjacent tubes 46 of the core 45 have adjacent side walls 48, 48' aligned with one another (FIG. 3). The elongate tubes 46 extend, depending on design load parameters, in their lengthwise direction preferably in the direction of the span of the bridge (FIG. 1). Alternatively, the tube 46 can be positioned to extend transverse to the direction of travel. Further, alternatively, tubes and other polygonal core members of a variety of lengths and cross-sectional heights and width dimensions can be provided in forming a deck of the modular structural section according to the present invention.

The tubes 46 are also preferably formed of a polymer matrix composite material comprising reinforcing fibers and a polymer resin. Suitable materials are the same polymer matrix composite materials as previously discussed herein, the discussion is hereby incorporated by reference. The tubes 46, are most preferably E-glass fibers in a vinylester resin (FIG. 3).

The tubes 46 can be fabricated by pultrusion, hand lay-up or other suitable methods including resin transfer molding (RTM), vacuum curing and filament winding, automated layup methods and other methods known to one of skill in the art of composite fabrication and are therefore not described in detail herein. The details of these methods are discussed in *Engineered Materials Handbook*, Composites, Vol. 1, ASM International (1993).

When fabricating by hand lay-up, the tubes 46 can be fabricated by bonding a pair of components (not shown). One component includes the vertical side wall 49 and a portion of the upper wall 64 and the lower wall 65. The other component includes the angled side wall 48 and the respective remaining portions of the upper wall 64 and lower wall 65. The upper and lower walls 64, 65 are bonded with an adhesive along the upper wall 64 and lower wall 65 where stresses are reduced.

It is believed that such forming overcomes the problem of node failure experienced in forming triangular shapes with composite materials. In a triangular section, the members behave as a pinned truss. Such a truss system transfers load directly through the vertex. To do so the truss encounters large amounts of inter laminar shear and tensile stresses. The trapezoidal tube 46 does not experience forces at a vertex such as those in a triangular section. The trapezoidal section of the tube 46 requires that the load be carried partially by bending the cross-section. Such bending relieves the inter laminar stresses resulting in a higher load carrying capacity.

Also, as described above, the sandwich panels 34 each also have an upper surface shown as an upper facesheet 35 and a lower surface shown as facesheet 40 (FIG. 3). The tubes 46 are sandwiched between a lower surface 36 of the upper facesheet 35 and the upper surface 41 of the lower facesheet 40. As seen in FIG. 3, the lower face sheet 40 and the upper face sheet 35 are sheets preferably formed of polymer matrix composite materials and more preferably formed of fiberglass fibers and a polymer or vinylester resin as described herein.

Having fabricated the upper and lower facesheets 35, 40 as described herein, the lower surface 36 of the upper face sheet 35 is preferably laminated or adhered to the upper surface 47 of the tubes 46 by a resin 26 and/or other bonding means and joined with the tubes 46 by mechanical or fastening means including, but not limited to, bolts or screws. Likewise, the upper surface 41 of the lower facesheet 40 is preferably laminated to the lower surface 27 of the tubes 46 by resin 26 or other bonding means and joined with the tubes 46 by mechanical fastening means including, but not limited to, bolts or screws.

The core 45, including the tubes 46, and the upper and lower facesheets 35, 40 can be alternatively joined with fasteners alone, including bolts and screws, or by adhesives or other bonding means alone. Suitable adhesives include room temperature cure epoxies and silicones and the like. Further, alternatively, the tubes could be provided integrally formed as a unitary structural component with an upper and lower surface such as a facesheet by pultrusion or other suitable forming methods.

As described, the sandwich panels 34, 34', 34" of the deck 32, being formed of polymer matrix composite material, also provide high through thickness, stiffness and strength to resist localized wheel loads of vehicles traveling over the bridge according to regulations such as those promulgated by AASHTO.

In the deck shown in FIGS. 1–7, the upper and lower facesheets 35, 40 are hand laid of polymer matrix composite material. In the deck 32 shown in FIGS. 1–7, the upper and lower facesheets 35, 40 are hand-laid, heavy weight, knitted, fiberglass fabric.

The upper and lower facesheets 35, 40 are each fabricated in this embodiment with multiple-ply quasi-isotropic fabric. Quasi-isotropic as used herein means an orientation of fibers approaching isotropy by orientation of fibers in several or more directions. In other words, quasi-isotropic refers to fibers oriented such that the resulting material has uniform properties in nearly all directions, but at least in two directions. The lay-up of the fabric in the facesheets 35, 40 is quasi-isotropic having fibers with an orientation of 0°/90°/45°/–45°. The fibers are approximately evenly distributed in orientations having approximately 25 percent with a 0° orientation, approximately 25 percent with a 90° orientation, approximately 25 percent with a 45° orientation, and approximately 25 percent with a –45° orientation.

The quasi-isotropic layup of the upper and lower facesheets 35, 40 prevent warping from non-uniform shrinkage during fabrication. The orientation of the facesheets also provides a nearly uniform stiffness in all directions of the facesheets 35, 40. Alternatively, other types of composite materials, with varying orientations, can be used to fabricate the upper and lower facesheets 35, 40. For example, alternatively, the facesheets can be formed with orientations other than quasi-isotropic layup.

The upper and lower facesheets 35, 40 are fabricated in the present embodiment by the following steps. First, the lower facesheets 40 and upper facesheets 35 are fabricated by hand layup using rolls of knitted quasi-isotropic fabric. Alternatively, the facesheets 35, 40 preferably can be fabricated by automated layup methods. The fibers of the upper and lower facesheets 35, 40 are given a predetermined orientation such as described depending on the desired properties.

While the upper and lower facesheets 35, 40, are fabricated using a hand-layup process, the core 45 including the facesheets 35, 40 can alternatively be fabricated by other methods such as pultrusion, resin transfer molding (RTM), vacuum curing and filament winding and other methods known to one of skill in the art of composite fabrication, which, therefore, are not discussed in detail herein. The details of these methods are discussed in *Engineered Materials Handbook: Composites*, Vol. 1, AJM International (1993). Further, the facesheets and core members alternatively can be fabricated as a single component such as by pultruding a single sandwich panel having an upper and lower facesheet and a core of tubes.

As shown in FIG. 3, a single upper face sheet 35 and a single lower face sheet 40 can each be adhered to a plurality of tubes. Alternatively, any number of facesheets and any number of tubes can be connected to form the sandwich panel of the deck for a modular section. Also, alternatively, various sizes and configurations of facesheets and cores can be provided to accommodate various applications. The resulting deck 32 is provided as a unitary structural component which can be used by itself or as a component of a modular section 30 for thereby constructing a support structure including a bridge or other structure therefrom. The deck 32 can be utilized in other structural applications as described herein.

Figure 7:
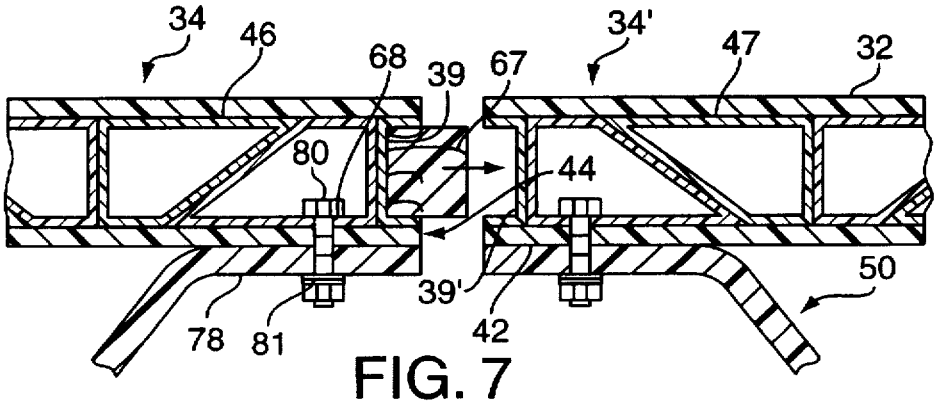
FIG. 7 is an enlarged cross-sectional view of adjacent panels of the sandwich deck of FIG. 2 being joined with a key lock.
Figure 5:
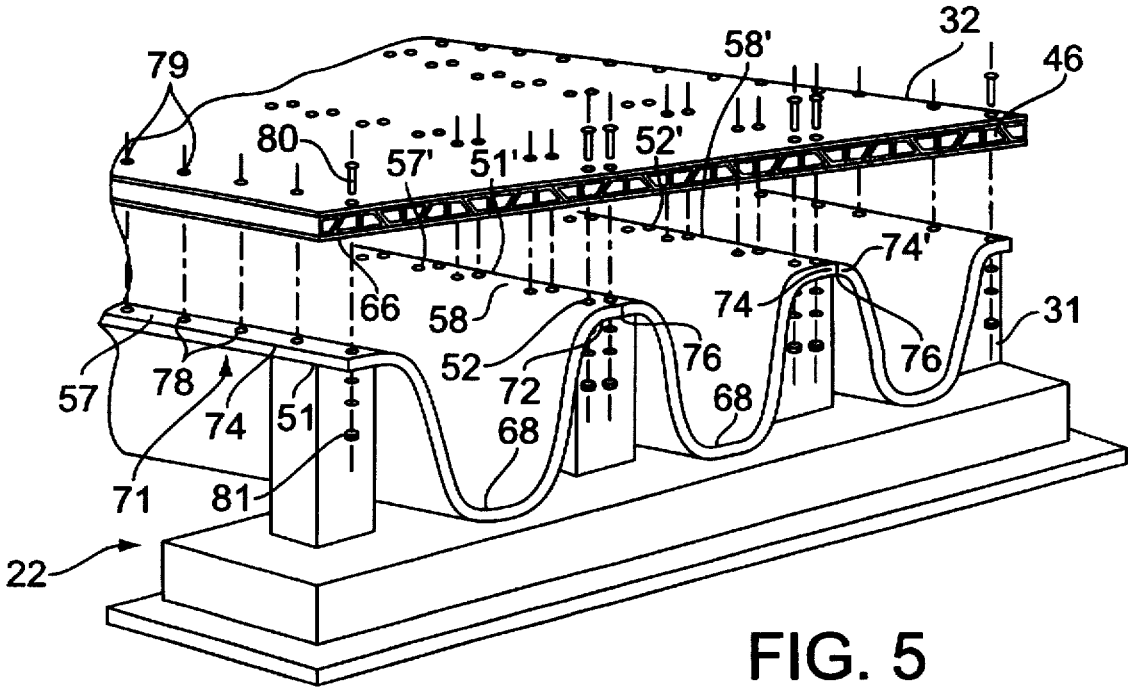
FIG. 5 is an exploded perspective view of the sandwich panel deck being positioned on the beams of the bridge of FIG. 2.

As shown in FIGS. 1 and 7, the three sandwich panels 34, 34', 34" are joined at adjacent side edges 33, 33', 33" to form a planar deck surface 29. The deck 32 is positioned generally above and coextensively with upper surfaces 57, 58 of the flanges 51, 52 of the beams 50 (FIGS. 1 and 5).

Each sandwich panel 34 contains a C-channel 39 at each end 44 for joining adjacent sandwich panels 34, 34' in forming the deck 32. As shown in FIG. 7, an internal shear key lock 67 is inserted into adjacent C-channels 39, 39' to join adjacent sandwich panels 34, 34'. The shear key lock 67 is preferably formed of a bulk polymer material including, but not limited to, polymer composite, polymer concrete mix. Such a shear key lock 67 formed of a polymer is preferred due to its chemical and corrosive resistant properties. Alternatively, the shear key lock 67 can be formed of various other materials such as wood, concrete, or metal.

The shear key lock 67 is bonded with the sandwich panels 34, 34' by an adhesive such as room temperature cure epoxy adhesive or other bonding means. Alternatively, the shear key lock 67 can be fastened with fasteners including bolts and screws, and the like.

Other methods of joining adjacent sandwich panels to form a deck could be utilized including plane joints with external reinforcement plates on the upper and lower surface of the sandwich panels, recessed splice joints with reinforcing plates, externally trapped joints with sandwich panels joined in a dual connector, match fitting joints, and lap splice joints. These joints and joining methods are known to one of ordinary skill in the art and, therefore, are not discussed in detail herein.

The Beam

Referring back to FIGS. 1 and 2, the modular section 30 also includes three beams 50, 50', 50". Any number of beams, alternatively, can be utilized to construct a modular section 30 of the bridge 20 depending on desired width, span and load requirements. Each of the beams 50, 50', 50" in the bridge 20 is generally identical in length, width and depth. However, beams of different lengths and or widths can be utilized in the modular section 30 of the bridge of the present invention.

As shown in FIG. 5, each of the beams 50 comprise lateral flanges 51, 52 which are positioned on and supported by one of the two support members 22. Each of the beams 50 has a medial web 53 between and extending below the flanges 51, 52. The medial web 53 includes an inclined sidewall 54 angled generally diagonally with relation to the lower face sheet 40. The flanges 51, 52 and the medial web 53 extend longitudinally along the length of the beams 50. The configuration of the flanges and the medial web can take a variety of configurations in alternative embodiments.

The flanges 51, 52 of the beams 50 are spaced apart, and each has a generally planar upper surface 57, 58. The upper surfaces 57, 58 contact the lower facesheets 40 to provide support thereto. The upper surfaces 57, 58 of each flange 51, 52 also provide a surface for bonding or bolting the beam 50 to the sandwich panel 34. The flanges 51, 52 are generally positioned parallel to the lower surface 42 of the lower facesheet 40.

The inclined side walls 54 of the beams 50 extend at an angle from the flanges 51, 52. Preferably, this angle is between about 20° to 35° (preferably about 28°) from the vertical perpendicular to the planar upper surfaces 57, 58 of a respective adjacent flange 51, 52. The beams 50 are designed for simple fabrication and handling.

The medial web 53 also has a curved floor 68 between the inclined side walls 54. The floor 68 extends throughout the length of the beam 50. The floor 68 defines a bottom trough of the U-shaped beam 50.

The fibers in the floor 68 are preferably substantially oriented unidirectionally in the longitudinal direction of the beam 50. Such unidirectional fiber orientation provides this beam 50 with sufficient bending stiffness to meet design requirements, particularly along its longitudinal extent.

The fibers in the inclined side walls 54 of the web 53 are oriented in the optimal manner to satisfy design criteria preferably in a substantially quasi-isotropic orientation. A significant number of ±45° plies are necessary to carry the transverse shear loads.

The inclined side walls 54 and curved floor 68 provide dimensional stability to the shape of the beam 50 during forming. The flanges 51, 52 and medial web 53 form a U-shaped open cross-section of the beam 50. The beam 50 is designed to carry multi-direction loads. The inclined side walls 54 transfer load between the deck (compression) and the floor (tension), and distribute the reaction load to the support members. As the beam 50 constitutes an open member, the resulting beam 50 provides torsional flexibility during shipping and assembly. However, when the beam 50 is connected with the deck 32, the combination thereof forms a closed section which is extremely strong and stiff. Alternative shapes and configurations of the beam 50 can be provided.

As seen in FIGS. 4 and 5, the flanges 51, 52 of the beams 50 each also have respective lower surfaces 71, 72. The lower surfaces 71, 72 each provide a surface for positioning the beam 50 on the columns 23 of the support members 22 (FIG. 5). In constructing the bridge 20, the beams 50 are positioned on the load bearing pad 24 of the columns 23 of the support members 22 to provide a simply supported bridge (FIGS. 4 and 5).

In the bridge 20, the U-shaped supports 50 are supported at opposite ends 55, 56 by the support members 22. The U-shaped beams 50 have sufficient strength, rigidity and torsional stiffness for shorter spans that they are provided unsupported in the center portion 69 between the ends 55, 56 supported by the support members 22. Alternatively, the beams can be supported at a variety of interior locations between the ends if desired or depending on the requirements of the span length.

The beams 50, 50', 50" are also positioned horizontally adjacent one another on the support members 22. The flanges 51, 52 of each beam 50 each have an outer edge 74 (FIG. 5). As illustrated in FIG. 5, adjacent outer edges 74, 74" of adjacent beams 50, 50' preferably butt form a butt joint 76. As shown in FIG. 5, the flanges 51', 52 of adjacent beams 50, 50' are preferably joined such that the flanges do not extend over or overlap each other with the medial web 53 of adjacent support webs 53, 53'. Alternatively, other joints can be provided including joints where the flanges overlap adjacent flanges without overlapping the medial portion of the beam.

Figure 6:
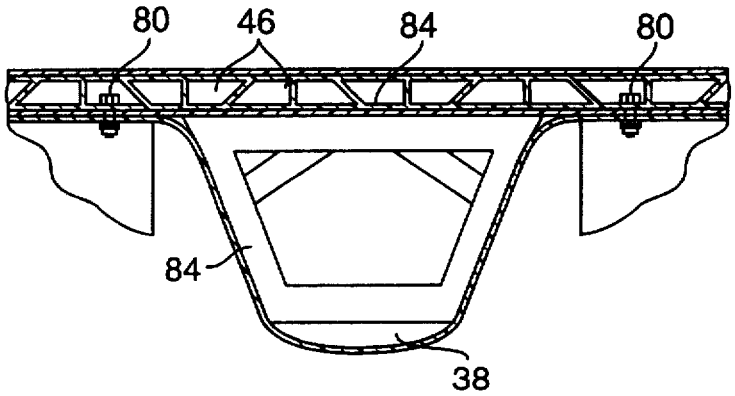
FIG. 6 is an end view of the modular section of the bridge of FIG. 2 showing a support diaphragm positioned in the end thereof.

FIG. 6 illustrates an internal transverse strut 84 inserted in the open trough at the ends 55, 56 of the beam 50. The strut 84 increases the torsional stability of the beam 50 for handling and maintains wall stability during installation. The beams 50 of the bridge 20 therefore provide an improvement over prior concrete and steel beams which are extremely rigid and can permanently deform or crack if subjected to torsional stress or loads during shipping. Alternatively, various configurations and shapes or deophragnis can be inserted in or on the face of the deck and/or beams of the modular structural section to provide stability to the modular structural system 30.

Each beam 50 in the bridge 20 is hand laid using heavy knit weight knitted fiberglass fabric. The beam 50 can be formed on a mold which has a shape corresponding to the contour of the beam 50. Hand layup methods are well-known to one of ordinary skill in the art and the details therefore need not be discussed herein. Alternatively, each beam 50 can be fabricated by automated layup methods.

The fabric used in the inclined side walls 54, 58 is a four-ply quasi-isotropic fabric and polyester resin matrix. The beam 50 can be fabricated to a predetermined thickness using hand layup or other method. An additional layer of a predetermined thickness of unidirectional reinforcement fiberglass is preferably added to the floor of the beams 50 interspersed between quasi-isotropic fabrics to further increase their bending stiffness. The total thickness of the beams 50 can vary over a range of thicknesses. Preferably the thickness of the beams is between about 0.5 inches and 3 inches. The inclined side walls 54 and floor 68 provide dimensional stability to the shape of the beam 50 during forming.

As explained with respect to the core 45 and the upper and lower facesheets 35, 40, the beams 50 can alternatively be fabricated by other methods such as pultrusion, resin transfer molding (RTM), vacuum curing and filament winding and other methods known to one of skill in the art of composite fabrication, the details of which are thereby not discussed herein.

Being formed of polymer matrix composite materials, each of the beams 50 shown in FIGS. 1–7, weighs under 3600 pounds for a 30 foot span design. Beams 50 can, alternatively, be provided with appropriate weights corresponding to the applicable span, width and space.

In constructing the bridge 20, the lateral flanges 51, 52 of the beams 50 are positioned on adjacent columns 31 of the support members 22. The medial web 53, including the inclined side walls 54 and the curved floor 68, are positioned in the trough portions 38 of the beams 50. The support members 22 provide stability to the components under load, prevents lateral shifting and facilitate load transfer from the deck through the beams and support members.

The beams 50 are also preferably provided with longitudinal ends 55, 56 configured to overlappingly join and thereby secure longitudinally adjacent beams 50, 50'. Therefore, bridges and support structures of various spans, including spans longer than the beams 50, can be constructed by joining beams end-to-end in this fashion. If overlap joints are utilized, the overlays would be fastened with an adhesive or by mechanical means. The joints could also be formed with an inherent interlock in the lap joints.

As shown in FIGS. 1, 2 and 5, the deck 32 is positioned above such that it generally coextensively overlies the upper surfaces 58, 57' of the adjacent flanges 51, 51'. The deck 32 is also positioned generally parallel with the upper surfaces 57, 57', 58, 58' of the flanges 51, 51', 52, 52' thereby providing a surface for bonding or bolting the beams to the deck.

The deck 32 is connected with the beams 50 by inserting bolts 80 through holes 66 through the lower facesheet 40 and through holes 78 through the flanges 51, 52 (FIGS. 5–7). The bolts 80 are then fastened with nuts 81 or other fastening means. The bolts 80 preferably are inserted in holes 78 which extend along the span of the flanges 51, 52 at intervals of approximately two feet. At the ends 55, 56 of the beams 50 the spacing of the bolts 80 is preferably reduced to about one foot. A row of bolts 80 is preferably inserted through each flange 51, 51', 52, 52' of adjacent beams 50, 50'.

To position and access the bolts 80 for securing, holes 79 are formed through the upper facesheet 35 and upper surface 47 of the tubes 46. These holes 79 have a predetermined diameter sufficient to allow for insertion of the bolts into the hollow center of the tubes 46. These holes 79 are also aligned with holes 66, 78 in the lower facesheet 40 and the flanges 51, 52.

In addition to bolting, the flanges 51, 52 and the deck 32 are also preferably bonded together using an adhesive such as concresive paste or like adhesives. Thus, a combination adhesive and mechanical bond is preferably formed between the beams 50, 50', 50" and the deck 32.

Alternatively, other connecting means can be provided for connecting the deck to the beams including other mechanical fasteners such as high strength structural bolts and the like. The deck and beams can alternatively be connected with only bolts or adhesives or by other fastening.

Also, as illustrated in FIG. 1, the bridge 20 preferably is provided with a wear surface 21 added to the upper surface 75 of the deck 32. The wear surface 21 is formed of polymer concrete or low temperature asphalt. Alternatively, this wear surface can be formed of a variety of materials including concrete, polymers, fiber reinforced polymers, wood, steel or a combination thereof, depending on the application.

Construction of a Support Structure in the Form of a Traffic Bridge

In order to construct the bridge 20 referenced in FIG. 1, support members 22 including vertical concrete columns 31 with load bearing pads 24 are each provided and positioned at a predetermined position and distance depending on the span. Adjacent vertical columns 31 are laterally positioned a predetermined distance apart corresponding to the distance of separation between the flanges 51, 52 of the beams 50, 50', 50". The support members 22 are also positioned longitudinally a predetermined distance apart equal approximately to the length of the separation of the ends 55, 56 of the beams 50, 50', 50" which are to be supported.

As shown in FIGS. 4 and 5, the beams 50 are then positioned on the support members 22. The lateral flanges 51, 52 of each beam 50 are positioned on and supported by adjacent vertical columns 31 of the support members 22 as described. Further, each longitudinal end 55, 56 of the beams 50, 50', 50" is positioned on and supported by a support member 22. Adjacent flanges 52 and 51' of adjacent beams 50 and 50' are positioned adjacent one another on a single column 31.

Adjacent sandwich panels 34, 34' are then positioned and lowered onto the beams 50, 50', 50". The sandwich panels 34 are also aligned next to adjacent sandwich panels 34' and connected with the shear key lock 67 or other connecting means as described above. The deck 32 is preferably aligned with the beams 50, 50', 50" such that the longitudinal ends of the deck 32 are positionally aligned with the ends defining the length of the beams 50. Likewise, the edges 86, 87 defining the width of the deck 32 are preferably aligned above the outside edges 88, 89 of the beams 50 defining the width of the three beams 50, 50', 50".

The deck 32 is then fastened to the beams 50 as described above using adhesives, fasteners including, but not limited to, bolts, screws or the like, other connecting means or some combination thereof. After aligning and connecting each of the sandwich panels 34, 34', 34", the deck 32, as shown in FIG. 1, is then completed. The bridge 20 includes guard rails along each side of the span of the bridge 20.

Alternatively, guard rails, walkways, and other accessory components can be added to the bridge. Such accessory components can be formed of the polymer matrix composite materials as described herein or other materials including steel, wood, concrete or other composite materials.

Alternatively, the bridge can be constructed utilizing other supports and construction methods known to one of ordinary skill in the art. A bridge 20 according to the present invention can also be provided as a kit comprising at least one modular structural section 30 having a deck 32 including at least one sandwich panel 34 and at least one beam 50 and, preferably, connecting means for connecting the deck 32 and the beams 50. Such a kit can be shipped to the construction site. Alternatively, a kit for constructing a support structure can be provided comprising at least one modular structural section having at least one sandwich panel configured and formed of a material suitable for constructing a support structure without necessitating a beam.

The use of the bridge 20 in remote terrains (e.g., timber, mining, park or military uses) is facilitated by such kits which can have components including modular sections 30 having a deck 32 including sandwich panels 34 and at least one beam 50, which each can be sized to have dimensions less than a variety of dimensional limitations of various transportation modes including trucks, rail, shipping and aircraft. For example, the beam 50 and sandwich panel 34 can be sized with dimensions to fit within a standard shipping container having dimensions of 8 feet by 8 feet by 20 feet. Further, the components can alternatively be sized to fit into trailers of highway trucks which have a standard size of up to a 12 foot width. Moreover, such a kit can be provided having dimensions which would fit in cargo aircraft or in boat hulls or other transportation means. Further, the components, including, but not limited to, the U-shaped beam 50 and sandwich panel 34, can be provided as described which are stackable within or on top of another to utilize and maximize shipping and storage space. The light weight of the components of the modular section 30 also facilitates the ease and cost of such transportation.

The lightweight modular components of the modular structural section 30 also facilitate pre-assembly and final positioning with light load equipment in constructing the bridge. As described, the bridge 20 of the present invention can be easily constructed. For example, for a 30 foot span bridge 20, a three man crew utilizing a front end loader or forklift and a small crane can construct the bridge in less than five to ten working days. As compared to bridges constructed by conventional steel and concrete materials, the highway bridge 20 is approximately twenty percent of the weight of a similar sized bridge constructed from conventional materials. Structurally the bridge 20 also provides a traffic bearing highway bridge designed to reduce the failure risk by providing redundant load paths between the deck and the supports. Further, the specific stiffness and strength far exceed bridges constructed of conventional materials, in the embodiment shown in FIGS. 1–7 being approximately as much as 60 per cent greater than conventional bridges.

The bridge 20 of the present invention can also be constructed to replace an existing bridge, and thereby, utilize the existing support members of the existing bridge. Prior to performing the steps of constructing a bridge described above, the existing bridge span of an existing bridge must be removed, while retaining the existing support members. The at least one beam 50 can then be placed on the existing support members and the bridge 20 constructed as described. Alternatively, additional support members can be positioned or cast on the existing supports and the bridge then constructed according to the method described herein.

Further, the modular structural section 30 or its components including the beam 50 or deck 32 can be used to also repair a bridge. An existing bridge section can be removed and replaced by a modular structural section 30 or component of the beam 50 or deck 32 as described. Further, a bridge 20, once constructed, can be easily repaired by removing and replacing a modular structural section 30, sandwich panel 34 or beam 50. Such repair can be made quickly without extensive heavy machinery or labor.

The bridge 20 of the present invention also can be provided with a variety of widths and spans, depending on the number, width and length of the modular structural sections 30. A bridge span is defined by the length of the bridge extended across the opening or gap over which the bridge is laid. Thus, the configuration of the modular structural section 30, with its sandwich panel 34 and beam 50, provides flexibility in design and construction of bridges and other support structures. For example, in alternative embodiments, a single sandwich panel may be supported by a single or multiple beams in both the span and width directions. Likewise, a single beam may support a portion or an entirety of one of more sandwich panels. Also, the length and width of the separate sandwich panels 34 need not correspond to the length and width of the beams 50 in a modular section 30 of the bridge 20 constructed therefrom. Alternatively, a variety of number of sandwich panels can be utilized to provide the desired span and width of the bridge.

Adjacent sandwich panels 34, 34' can be joined longitudinally in the direction of the span 21 of the bridge 20, as shown in FIG. 1, and/or laterally in the direction of the width of the bridge. As such, a bridge also can be provided with a variety of lanes of travel.

As the beams 50 can also be supported at a variety of locations along their length, the bridge span is not limited by the length of the beams. The span of the bridge 20 shown in FIG. 2 coincides with the length of the beams 50. However, beams, in other embodiments, are provided which can be joined with adjacent beams longitudinally to form a bridge having a span comprising the sum of the lengths of the beams.

The bridge 20 of the present invention is a simply supported bridge which is designed to meet AASHTO specifications as previously incorporated by reference herein. As such, the bridge meets at least specific AASHTO standards and other standards including the following criteria. The bridge supports a load of one AASHTO HS20-44 Truck (72,000 lb) in the center of each of four lanes. The bridge also is designed such that the maximum deflection (in inches) under a live load is less than the span divided by 800. The allowable deflection for a 60 foot span would be less than 0.9 inches. Further, the bridge meets California standards that for simple spans less than 145 feet, the HS load as defined by AASHTO standards produce higher moment and deflection than lane or alternative loadings.

The bridge 20 is also designed to meet certain strength criteria. The bridge 20 has a positive margin of safety using a "first-ply" as the failure criteria and a safety factor of four (4.0); which is commonly used in bridge construction to account for neglected loading, load multipliers, and material strength reduction factors. A positive margin of safety is understood to one of ordinary skill in the art, and the details are therefore not discussed herein.

Further, the bridge is designed and configured such that its buckling eigenvalue (E.V.) $\alpha/FS>1$, wherein (E.V.) is the buckling eigenvalue, $\alpha$ is the knockdown factor of said modular structural section, and FS is the factor of safety. Such buckling considerations are also known to one of ordinary skill in the art and therefore not discussed in detail herein.

In the bridge shown in FIGS. 1–7, shear loads must be transmitted between the web 53 and flanges 51, 52 of the beams 50, 50', 50" and the sandwich panels 34, 34' of the deck 32. This load transfer is achieved in this embodiment of the bridge 20 by bolting. The maximum expected shear load is approximately 4,000 lbs., while the capacity exceeds 17,000 lbs. The deformation and fracture behavior appears ductile leading to load redistribution to surrounding bolts rather than catastrophic failure. Being made of a polymer matrix composite material which is environmentally resistant to corrosion and chemical attack, the sandwich panels 34, as well as the beams 50 can also be stored outdoors, including on site of the bridge 20 construction, without deterioration or environmental harm. The sandwich panels 34 and the beams 50 are preferably gel coated or painted with an outer layer containing a UV inhibitor. Further, the sandwich panels 34 and the beams 50 can be utilized in applications in corrosive or chemically destructive environments such as in marine applications, chemical plants or areas with concentrations of environmental agents.

The invention will now be described in greater detail in the following non-limiting example.

EXAMPLE

A trapezoidal tube deck for the 30 foot bridge described was constructed. The sandwich panels were constructed comprising a 6.5 inch deep E-glass/vinylester trapezoidal tubes and facesheets of all E-glass fibers. The trapezoidal tubes were made by hand lay-up. The tubes had a 0.25 inch thick trapezoidal section of 80 percent ±45° fabric with 20 per cent 0° tow fibers. In addition, a 0.25 inch floor of 100 per cent 0° fibers was applied to the top and bottom surfaces. The hand lay-up tubes had a fiber volume of about 40 per cent.

The deck included sandwich panels which are 7.5 feet in length in the direction of the span and 15 feet in width in the direction transverse to the span. The bridge was simply supported at the ends of the 30 ft. span. The deck was designed to have a maximum depth limit of 9 inches with a 0.75 inch polymer concrete wear surface bonded to the top of the deck, leaving 8.25 inches for the sandwich panel. The facesheets were 0.85 inch thick with a layup of 0°/45°/90°/−45°.

The upper and lower facesheets were each fabricated with alternating layers of quasi-isotropic and unidirectional knitted fabric. The outer quasi-isotropic plies provide durability while the unidirectional plies add stiffness and strength. The upper facesheet included a construction of multiple plies. The upper facesheet included a lower ply of 52 oz quasi-isotropic fabric, a middle layer of 3 plies of 48 oz unidirectional fabric and an upper layer of 12 plies of 52 oz quasi-isotropic fabric.

The lower facesheet likewise included a construction of multiple plies. The lower facesheet included an upper ply of 52 oz. quasi-isotropic fabric, a middle layer of 3 plies of 48 oz. unidirectional fabric and a lower layer of 12 plies of 52 oz. quasi-isotropic fabric.

A wheel load was applied in a deck section according to AASHTO 20-44 standards using a hydraulic load frame. An entire axle load of 32 kips must be carried by a side 7.5 long panel without any contribution from an adjacent panel. Each wheel load is 16 Kips. The wheel load is spread over an area of approximately 16 inches by 20 inches which is the size of a double truck tire footprint.

An ABACUS model was used to generate plots of the stresses in all directions in the critical region.

The bridge meets the margin of safety defined as $$MS = \frac{\text{Allowable Stress}}{\text{Applied Stress}} - 1$$

with a positive margin of safety indicating no failure at the design load.

Under these load conditions, the critical condition for the E-glass deck is inter laminar shear. In this deck, the failure occurs first in the top section of the pultrusion at the outer face between the top of the pultrusion and the diagonal member. The failure will occur at 2.51 times the 32 Kips load or about 80 Kips.

The deck was also designed to maintain a bending stiffness no less than 80 Kips/inch which is the stiffness of an equivalent concrete slab. The deck was further designed to withstand an ultimate design load of 90 Kips which is approximately two (2) times the AASHTO traffic wheel load specifications.

The deck exhibited consistent stiffness of 85 Kips/in under cyclic loading up to 180 kips. The deck also withstood 218 kips which is the maximum limit of the load fixture before showing a drop in stiffness to 79 kips/inch.

In the drawings and specification, there has been set forth a preferred embodiment of the invention and, although specific terms are employed, the terms are used in a generic and descriptive sense only and not for purposes of limitation, the scope of the invention being set forth in the following claims.

That which is claimed:

1. A load bearing support structure comprising:

at least one modular structural section; and support means supporting said at least one modular structural section;

said at least one modular structural section supported on and connected with said support means;

said at least one modular structural section comprising:

a load bearing deck including at least one sandwich panel, said at least one sandwich panel having:

an upper surface;

a lower surface; and a core including, a plurality of adjacent, substantially hollow, elongated core members positioned between said upper surface and said lower surface, each of said elongated core members including a pair of side walls and upper and lower walls connecting the side walls, at least one side wall of said pair of side walls is disposed at an oblique angle to one of said upper and lower surfaces such that said pair of side walls and said upper and lower walls, when viewed in cross-section, define a polygonal shape, and each of said elongated core members has one of said side walls positioned generally adjacent to one of said side walls of one of the adjacent elongated core members and the other of said side walls positioned adjacent to one of said side walls of one of the adjacent elongated core members.

2. The support structure as defined in claim 1, wherein said at least one modular structural section further comprises:

at least one beam having a pair of lateral flanges, each flange of said pair of lateral flanges positioned on and supported by one of said support means, said at least one beam further comprising a medial web between and extending below said pair of lateral flanges, said at least one sandwich panel supported by said at least one beam.

3. The support structure as defined in claim 1, wherein said elongated core members are aligned longitudinally in a direction of a span of said support structure.

4. The support structure as defined in claim 1, wherein said elongated core members have a cross-section that defines a trapezoid.

5. The support structure as defined in claim 1, wherein said elongated core members are formed of a polymer matrix composite material comprising reinforcing fibers and a polymer resin.

6. The support structure as defined in claim 1, wherein said upper surface comprises an upper facesheet, and said lower surface comprises a lower facesheet, said upper surface and said lower surface being formed of a polymer matrix composite material comprising reinforcing fibers and a polymer resin.

7. The support structure as defined in claim 1, wherein said at least one sandwich panel comprises a plurality of interconnected sandwich panels.

8. A support structure as defined in claim 1, wherein said support means are connected with said at least one modular structural section, such that said support structure is a simply-supported support structure.

9. The support structure as defined in claim 2, wherein said support structure comprises at least one support member, wherein at least one of said at least one beam and said at least one support member is formed of a polymer matrix composite material comprising reinforcing fibers and a polymer resin.

10. The support structure as defined in claim 1, further comprising a wear surface overlying an upper surface of said deck for withstanding foot and vehicular traffic.

11. A modular structural section for constructing a support structure comprising:

a load bearing deck including at least one sandwich panel having:

an upper surface;

a lower surface; and a core including, a plurality of adjacent substantially hollow, elongated core members positioned between said upper surface and said lower surface, each of said elongated core members comprises a pair of side walls and upper and lower walls connecting the side walls, at least one of said side walls is disposed at an oblique angle to one of said upper and lower surfaces such that said pair of side walls and said upper and lower walls, when viewed in cross-section, define a polygonal shape, and each of said elongated core members has one of said side walls positioned generally adjacent to one of said side walls of one of the adjacent elongated core members and the other of said side walls positioned adjacent to one of said side walls of one of the adjacent elongated core members; and modular support means supporting said deck, said deck connected with and supported on said modular support means.

12. The modular structural section as defined in claim 11, wherein said modular support means of said at least one modular structural section comprise:

at least one beam having a pair of lateral flanges, said pair of lateral flanges adapted to be positioned on and supported by a support member, said at least one beam further comprising a medial web between and extending below said flanges, said at least one sandwich panel supported by said at least one beam.

13. The modular structural section as defined in claim 11, wherein said plurality of elongated core members are aligned longitudinally in a direction of a span of the modular structural section.

14. The modular structural section as defined in claim 11, wherein said elongated core members have a cross-section that defines a trapezoid.

15. The modular structural section as defined in claim 11, wherein said elongated core members are formed of a polymer matrix composite material comprising reinforcing fibers and a polymer resin.

16. The modular structural section as defined in claim 15, wherein each of said core members includes longitudinally opposite end portions, a portion of said reinforcing fibers of at least one of said elongated core members is unidirectionally oriented between said longitudinally opposite end portions of said elongated core members.

17. The modular structural section as defined in claim 11, wherein at least one of said upper surface and said lower surface further comprises facesheets formed of a polymer matrix composite material comprising reinforcing fibers and a polymer resin.

18. A method of constructing a support structure comprising the steps of: providing the at least one support member;

positioning at least one modular structural section on said at least one support member, said at least one modular structural section comprising:

at least one beam supported on said at least one support member, and a load bearing deck supported on said at least one beam, said deck including at least one sandwich panel having:

a core including a plurality of adjacent elongated core members each having side walls and upper and lower walls connecting the side walls, which when viewed in cross-section define a polygonal shape, and each of said elongated core members has one of said side walls positioned generally adjacent to one of said walls of one of the adjacent elongated core members and the other of said side walls positioned adjacent to one of said side walls of one of the adjacent elongated core members; and connecting said at least one modular structural section and said at least one support member.

19. The method of constructing a support structure as defined in claim 18, wherein said polygonal shape is a trapezoid.

20. The method of constructing a support structure as defined in claim 18, wherein said step of positioning said at least one modular structural section further comprises the steps of:

positioning said at least one beam upon said at least one support member;

positioning said load bearing deck upon said at least one beam; and connecting said at least one beam and said deck.

21. The method of constructing a support structure as defined in claim 20, wherein said step of positioning said deck comprises positioning said elongated core members in a longitudinal direction generally parallel to a direction of a span of said support structure.

22. The method of constructing a support structure as defined in claim 18, further comprising the step of:

applying a wear surface to an upper surface of said deck for withstanding foot and vehicular traffic.

23. The method of constructing a support structure as defined in claim 18, wherein said step of positioning said deck further comprises the steps of:

positioning a plurality of load bearing deck panels on said at least one beam, each panel of said plurality of load bearing deck panels formed of a first polymer matrix composite material; and interconnecting each panel of said plurality of load bearing deck panels with an adjacent deck panel.

24. A method of constructing a support structure as defined in claim 18, wherein said connecting step comprises connecting said at least one support member and said modular structural sections such that said modular structural sections are simply supported.

25. The method of constructing a support structure as defined in claim 18, wherein said step of providing comprises locating existing support structure support members positioned to receive and support said at least one modular structural section.

26. The method of constructing a support structure as defined in claim 25, further comprising the step of removing an existing support structure span while retaining existing support members spaced apart a predetermined distance, said removing step preceding said locating step.

27. A load bearing deck structure comprising:

at least one sandwich panel including:

an upper surface;

a lower surface; and a core including a plurality of adjacent substantially hollow, elongated core members positioned between said upper surface and said lower surface, each of said elongated core members including a pair of side walls and upper and lower walls connecting the side walls, at least one of said side walls is disposed at an oblique angle to at least one of said upper and lower surfaces such that said pair of side walls and said upper and lower walls, when viewed in cross-section, define a polygonal shape, and each of said elongated core members has one of said side walls positioned generally adjacent to one of said side walls of one of the adjacent elongated core members and the other of said side walls positioned adjacent to one of said side walls of one of the adjacent elongated core members;

said deck adapted to be supported by support means in constructing a structure wherein at least one of said plurality of elongated core members is formed of a polymer matrix composite material comprising reinforcing fibers and a polymer resin.

28. The deck structure according to claim 27, wherein said upper and lower surfaces are generally parallel and each of said elongate members further comprises at least one vertical side wall disposed generally perpendicular to said upper and lower surfaces, said vertical side wall providing structural support for said upper and lower surfaces.

29. The deck structure as defined in claim 27, wherein said upper surface comprises an upper facesheet and said lower surface comprises a lower facesheet, at least one of said upper facesheet and said lower facesheet is formed of a polymer matrix composite material comprising reinforcing fibers and a polymer resin.

30. The deck structure according to claim 27, wherein at least one of said elongated core members is formed of a polymer matrix composite material comprising reinforcing fibers and a polymer resin.

31. The deck structure as defined in claim 30, wherein each of said core members includes longitudinally opposite end portions, a portion of said fibers is unidirectionally oriented between said longitudinally opposite end portions.

* * * * *

UNITED STATES PATENT AND TRADEMARK OFFICE

CERTIFICATE OF CORRECTION

PATENT NO. : 5,794,402

DATED : August 18, 1998

INVENTOR(S) : DUMLAO et al.

It is certified that error appears in the above-identified patent and that said Letters Patent is hereby corrected as shown below:

Col. 12, l. 65: Change "74"" to --74'--

Signed and Sealed this

Twenty-third Day of November, 1999

*Attest:*

Q. TODD DICKINSON

*Attesting Officer*

*Acting Commissioner of Patents and Trademarks*